United States Patent [19]

Graham

[11] 4,249,890

[45] Feb. 10, 1981

[54] PRODUCTION OF HEATED BITUMINOUS MIXES

[75] Inventor: Kenneth P. Graham, Surrey Hills, Australia

[73] Assignee: K. P. Graham & Associates Pty. Ltd., Surrey Hills, Australia

[21] Appl. No.: 917,705

[22] Filed: Jun. 21, 1978

[51] Int. Cl.[3] ..... F27B 14/00

[52] U.S. Cl. ..... 432/13; 236/15 C; 432/47; 432/103

[58] Field of Search ..... 432/51, 55, 36, 37, 432/47, 103, 105, 13; 236/15 BR, 15 BB, 15 BD, 15 C

[56] References Cited

U.S. PATENT DOCUMENTS

| | | | |
|---|---|---|---|
| 3,595,544 | 7/1971 | Curtis et al. | 432/37 |
| 4,022,569 | 5/1977 | Farago et al. | 432/51 |

FOREIGN PATENT DOCUMENTS

| | | | |
|---|---|---|---|
| 1904196 | 8/1970 | Fed. Rep. of Germany | 432/47 |

*Primary Examiner*—John J. Camby
*Attorney, Agent, or Firm*—Ladas & Parry

[57] ABSTRACT

A process for the production of heated aggregate mix, such as bituminous mix, and a reactor for carrying out the process. In one aspect, the process entails the control of gas flow through a tumbler drum, preferably by controlling exhaust from the drum, in dependence upon the continuous monitoring of a parameter, such as gas pressure within the drum. In a second aspect the aggregate contents of the drum are heated by using a burner to preheat the gas flow, a technique which permits admission of the drum feed as a homogenous stabilized mix.

16 Claims, 3 Drawing Figures

PRODUCTION OF HEATED BITUMINOUS MIXES

FIELD OF THE INVENTION

This invention is concerned with the production of heated aggregate mixes, especially bituminous mixes. The invention has particular, though not exclusive, application to processes for the production of bituminous mixes of the kind in which a cold aggregate mix and a bituminous binding agent are fed to a reactor in the form of an elongate hollow rotatable drum in which the feed is heated and thereby converted to a bituminous mix in which the binding agent adheringly coats the aggregate particles as the bulk of moisture contained in the feed is vapourized and carried airborne from the drum.

BACKGROUND TO THE INVENTION

Various configurations of reactor have been proposed for processes of the above kind. They generally include a liquid or gas fuel burner located at one end of the drum and having one or more air intakes which provide the bulk of the oxygen to complete combustion and a heated airflow through the burner. In the conventional reactor, an air-atomised burner projects a flame into the drum to heat the aggregate mix by flame contact, the binding agent being admitted into the hot mix substantially out of reach of the flame.

It has proven difficult with these known reactors to ensure liquefaction of the binding agent and removal of the moisture to a degree of efficiency adequate to provide a hot mix of desired specification, while ensuring that loss of the binding agent through oxidation is kept within acceptable limits. The taking up of large volumes of fines in the exhausted airflow has given rise to a considerable dust problem in many prior art systems and the high airflow rates necessary on the one hand to atomise the burner fuel and feed the flame and on the other to remove fines have led to often unacceptably high noise levels. These problems have also applied where bituminous agent is not added to the drum but combined batchwise with heated, unbound aggregate mix retrieved from the drum.

To date, the difficulties just outlined have been lessened by the use of sophisticated dust and noise control equipment and/or by premixing of the feed products with an additive in a series of steps designed to virtually eliminate the production of free fines within the drum. However, the former of these approaches has proven very expensive, while the latter has resulted in an unduly high level of bitumen oxidation and in loss of bitumen by entrainment in the exhaust flow. Another approach has been to reduce air flow requirements by substituting more sophisticated mechanically atomised liquid fuel burners for the relatively much simpler air atomised burners traditionally employed, but this has proven to be only a partial palliative.

SUMMARY OF THE INVENTION

The basis of the present invention is in part the realization that advantageous results can be achieved by controlling the air flow from the drum in dependence upon a condition monitored within the drum.

In the first aspect, the invention accordingly provides a reactor for use in the production of heated aggregate mixes comprising:

a body defining a closed treatment chamber, which body is mounted for rotation about a predetermined longitudinal axis and arranged to permit tumbling of its contents when in such rotation;

one or more preferably airtight inlet ports for feeding base products including at least an aggregate mix into the treatment chamber;

a preferably airtight outlet port for retrieving heated mix from the treatment chamber;

respective inlet and outlet ports for admitting air to the treatment chamber at or adjacent one axial end thereof and exhausting gases at or adjacent the other axial end;

means for inducing a flow of gases from the chamber to the gas exhaust port;

a burner for heating the base products in the chamber to a temperature sufficient to convert them to a heated mix of desired specification;

means to monitor one or more parameters indicative of a condition or conditions apertaining at one or more locations in the treatment chamber;

means to control said gaseous flow through the chamber in dependence on said monitoring.

Preferably, the burner is disposed relative to the base products feed ports for heating said products to effect said conversion by heating said gaseous flow prior to its contacting the base products.

The control means advantageously includes volume rate of flow control valving associated with the gas outlet port which valving is arranged to be operated in dependence on said monitoring so that, independently of the rate of oxygen combustion by the burner, volume rate of withdrawal of gases from the chamber is just as required to ensure efficient removal of gaseous combustion products and unburnt gases, and of water vapour to the extent required to reduce moisture in the output hot mix to the level specified. A constant evacuation rate exhaust fan may be mounted in an exhaust duct communicating with the gas outlet port and the valving may then comprise an adjustable bleed from atmosphere interposed in the exhaust duct between the gas outlet port and the fan.

Further preferably, the control means may include volume rate of flow valving associated with the burner which valving is connected to a device for determination of the temperature of the retrieved mix, whereby air inflow at the gas inlet port can be controlled in dependence on said temperature determination.

Advantageously, the reactor is associated with means to mix and to a large extent, although not necessarily, wholly stabilize and homogenize the base products prior to their being fed into the treatment chamber so as to minimize dust creation during the conversion process.

In a second aspect, the invention provides a method of producing a heated aggregate mix comprising the steps of:

feeding base products including an aggregate mix into a closed treatment chamber;

maintaining a flow of gases longitudinally through the chamber;

tumbling the base products in the chamber while heating them to a temperature sufficient to convert the base products to a heated mix of desired specification; and extracting the mix from the chamber;

wherein one or more parameters indicative of a condition or conditions at one or more locations in the chamber are monitored as said flow maintaining and product heating steps are carried out, and wherein said gaseous flow is controlled in dependence on said monitoring.

In an important preferred arrangement in accordance with the invention, the mix production process is controlled wholly by monitoring only the temperature of the product mix and the net gas pressure in the treatment chamber. It is believed that under normal conditions, the values of these two variables adequately reflect other product variables such as moisture content and rate of output.

In a third aspect, the invention provides a method of producing a heated aggregate mix comprising the steps of:

feeding base products including an aggregate mix into a closed treatment chamber;

maintaining a flow of gases longitudinally through the chamber;

tumbling the base products in the chamber while heating them to a temperature sufficient to convert the base products to a heated mix of desired specification; and extracting the mix from the chamber;

wherein the base products are heated to effect said conversion by heating said gaseous flow prior to its contacting the base products.

In a particularly advantageous application of the methods of the invention, in either of its aspects, the base products fed to the treatment chamber include a bituminous binding agent and the base products are heated while being tumbled to a temperature sufficient to convert the base products to a heated bituminous mix in which the binding agent is adheringly coated on the aggregate particles.

BRIEF DESCRIPTION OF THE DRAWINGS

The invention will now be described in greater detail with reference to the accompanying drawings in which.

DESCRIPTION OF THE PREFERRED EMBODIMENTS

Figure 1:
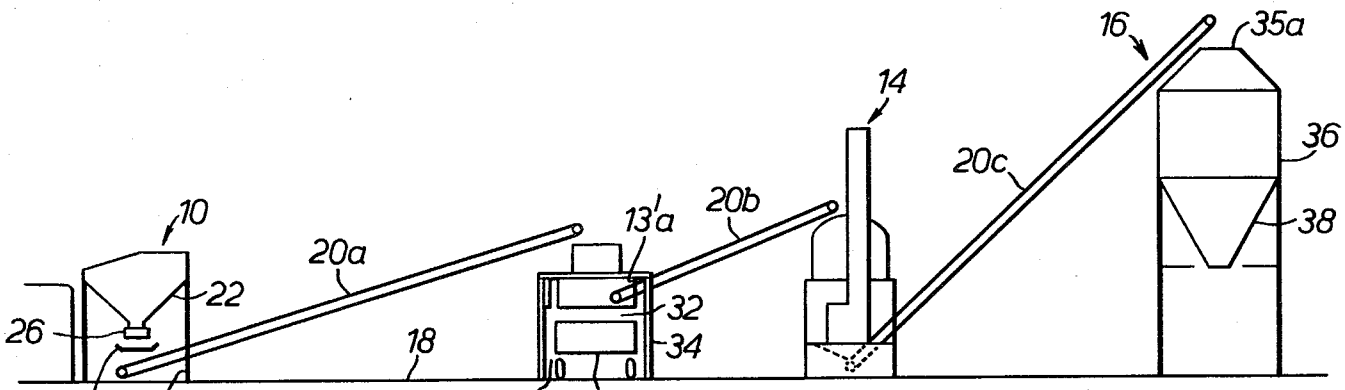
FIG. 1 schematically illustrates, in side elevation, the principal components of a multi-purpose plant which may be utilized for the production of heated bituminous mix.

The plant illustrated in FIG. 1 may advantageously be located at or adjacent an actual site at which aggregate material is being currently extracted. The plant may be viewed as consisting of four readily separable sub-plants: a storage and proportioning unit 10, a pug-mill 12, a heated bituminous mix reactor 14 and a mix storage unit 16. These four sub-plants are spaced apart on a ground surface 18 and are interconnected in linear succession by successive materials conveyors **20*a*, 20*b*, and 20*c*. In accordance with the invention, it is intended that sub-plants 10 and 12 be available for the processing of differing materials and the production of milled products of differing types and grades and that the units 14, 16 be provided as an accessory to units 10 and 12** in the sense that they are detachable therefrom and do not interfere with the other purpose uses of the proportioning unit and pug-mill combination.

Accordingly, unit 10 comprises a plurality of aggregate storage bins 22 mounted on one or more frameworks 24 and having respective underside outlet feeders 26 arranged to direct material onto one or more transverse conveyors 28. These conveyors are mounted to carry material towards and onto conveyor **20*a* whereby aggregate mixes of varying proportions can be prepared on the latter conveyor. Unit 10** may also include receptacles for the storage of other products, such as silos for filler material and the like and tanks for bitumen or other liquid products.

Pug-mill 12 includes an inlet opening 30 at its upper side and an outlet opening 32 on its underside. The whole assembly is mounted on a raised, leg-supported platform 34 so that transport trucks such as that depicted at 35 may be driven under the structure to receive mixed products from the mill while standing in the space 37.

Mounted to the underside of platform 32 is a slide assembly 13 including a feed hopper **13*a*. Conveyor 20*b* is moveable in and out of hopper 13*a* between a first condition illustrated, in which it is positioned to receive milled material from outlet 32** and a second condition in which it is displaced to one side so that material may pass through the hopper into a truck or like vehicle.

Reactor 14 may be of any known construction with conveyors **20*b* and 20*c* respectively delivering raw feed and binder and withdrawing fresh mix from appropriate points in the plant. Conveyor 20*c* directs the heated mix to an upper intake 35*a* for one or more large hot mix storage bins 36 having raised funnel feeders 38** for directing the hot mix into trucks for delivery to a laying site.

It will no doubt be appreciated that the illustrated plant constitutes a major improvement over known hot mix production plants in that the aggregate preparation stages of the plant are separably utilizable for other aggregate processing functions. It is also to be noted that each component of the plant may be structured to allow its ready transport from site to site.

Figure 2:
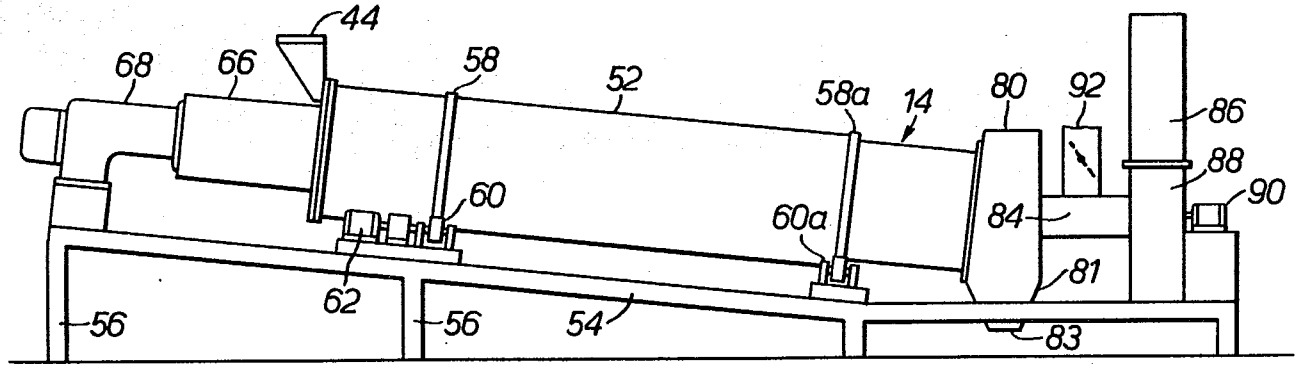
FIG. 2 is a schematic view in side elevation of an inventive bituminous mix reactor which may form part of the plant depicted in FIG. 2.
Figure 3:
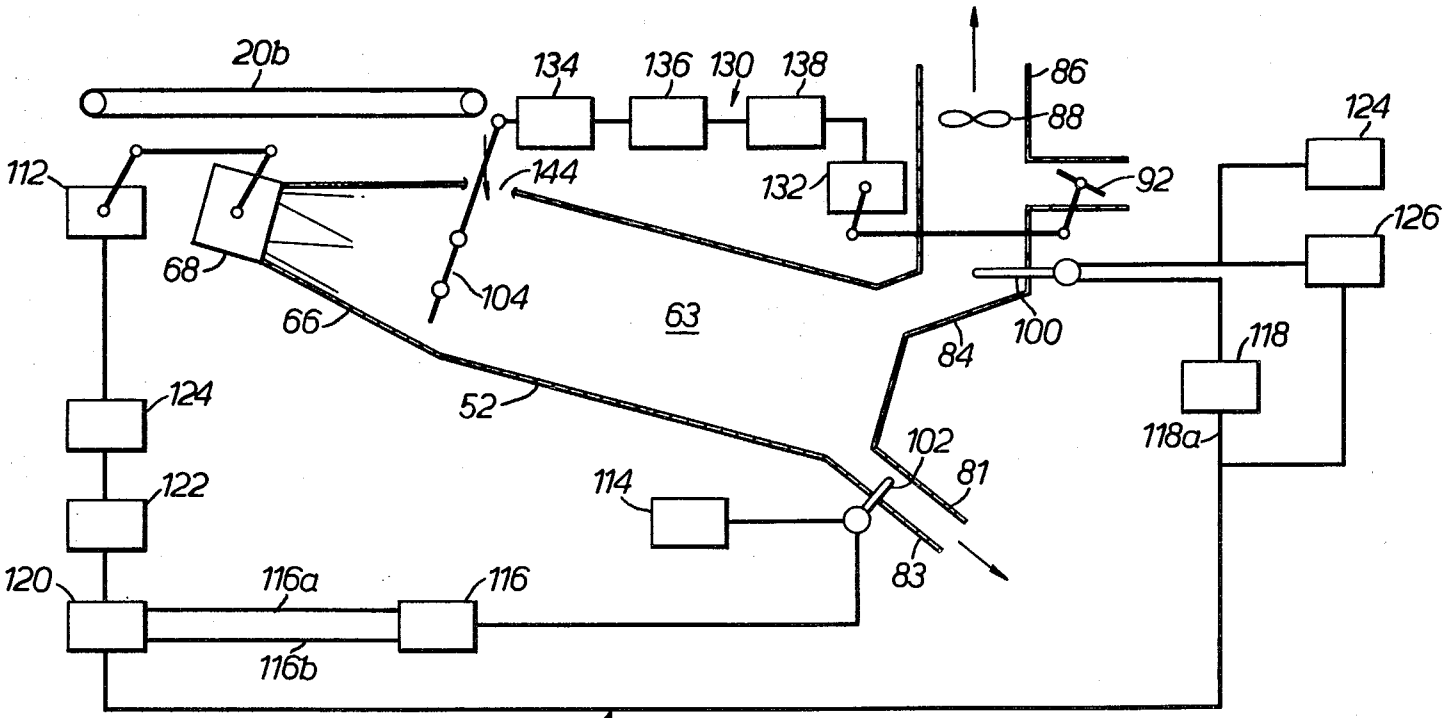
FIG. 3 is a block diagram of the monitor and control circuitry for the reactor shown in FIG. 2, the principal parts of the reactor being shown schematically.

One form of the hot mix reactor 14 which is in accord with the invention is illustrated in FIGS. 2 and 3. For use in the inventive process, aggregates in proportions chosen at unit 10 are prepared by being mixed in pug-mill 12 with bituminous binding agent to give a substantially stabilized homogenous "cold mix" feed of aggregates and fine grained binding agent. If desired, this cold mix may be stockpiled by being taken out at pug-mill 12. It may later be brought to the reactor, either without further preparation or after being subjected to further stabilization processes.

The cold mix is carried on conveyor **20*b* to the inlet port 44 (FIG. 2) of an elongate hollow drum 52 forming part of reactor 14 the interior of drum 52 defines a treatment chamber 63, (FIG. 3). Drum 52 is mounted with its axis inclined at a small angle to horizontal on a raised platform 54 which, as illustrated, is in turn supported on the ground surface 18 by a plurality of spaced apart posts 56. The drum may, of course, be alternatively supported for ready transport. The drum is of a quite conventional structure being provided with spaced annular tracks, 58, 58*a* which support the drum on respective sets 60, 60*a* of rollers trunnion mounted on platform 54. The drum is rotatable about its longitudinal axis by respective motor and differential unit coupled to the roller sets 60; one such representative unit is depicted at 62 in FIG. 2. Flights and lifters are provided interiorily of the drum to effect tumbling of its contents as the drum is rotated. Intake chute 44 communicated with the interior of drum 52** by way of a flow responsive flap and an annular labyrinth seal which renders the inlet substantially airtight. The drum may be thermally insulated if desired or considered necessary.

Parameters such as the inclination and rate of rotation of the drum and the details of its interior design together determine the residence time of the materials in the drum and are thus set to accord with the specification of the output material desired. Generally, the drum will be of a standard construction, the tilt angle being adjustable at installation in regard to the general class of work desired and the rate of rotation providing a fine adjustment.

Fixedly mounted to platform 54 is a cylindrical housing 66 providing a forward combustion chamber which extends coaxially from the raised end of the drum and is of a generally conical configuration with its broader end opening into the interior of the drum. Drum 52 engages housing 66 for relative rotation in a substantially airtight assembly by way of the above-described labyrinth seal.

Housing 66 is interposed between the drum and a liquid fuel atomised burner 68 which may be a mechanically atomized burner of the type manufactured for example by the Weishaupt group of companies. Burner 68 includes one or more air inlet dampers controlled jointly by a motor, not shown in FIG. 2 but indicated by block 112 in FIG. 3. The air dampers and fuel supply valve are controlled in unison to provide balanced combustion conditions.

The total axial length of the combustion chamber of burner 68 and chamber 66 is chosen so that at maximum heat generation, that is, with the burner full on, combustion is just complete at the forward end of chamber 66 adjacent intake 44.

The lower end of drum 52 is open and communicates by way of a labyrinth sealing arrangement with the interior of a manifold or expansion box 80 which tapers at its lower end to form a discharge chute 81 for heated bituminous mix formed in the drum. The heated mix flows out of the drum and downwardly through a substantially airtight flap controlled chute opening 83 for collection on the conveyor **20*d* (FIG. 1**).

A duct 84 extends horizontally from the expansion box 80 and communicates the interior of the box with a vertical exhaust stack 86. An exhaust fan is mounted at 88 in the exhaust stack and is driven by an externally mounted motor 90. This motor and exhaust fan assembly is rated for a constant volume rate of evacuation. Duct 84 is provided with a damper controlled bleed 92 which is adjustable by way of a modulating motor 132 (FIG. 3) to vary the proportion of fan exhausted flow which emanates from drum 52.

The feed introduced through chute 44 may be solely loose aggregate mix but in the preferred process under discussion, the feed is typically formed by premixing base products comprising an aggregate mix and a bituminous binding agent to at least to a large extent stabilize and homogenize the products prior to their being fed to the chamber. Pre-used bituminous mix may be recycled by incorporation into the premixed feed. The feed enters the rotating drum and passes down the drum, being tumbled by being divided, lifted and dropped by the action of the flights and lifters within the drum as it does so. The heated gaseous flow emanating from combustion chamber 66, which flow may include some unburnt air and combustion products, is of a temperature sufficient to effect conversion of the feed to heated bituminous mix by vapourizing moisture in the feed and simultaneously coating all granulations with binding agent in a uniform thickness by physical contact of the granulations with liquefied bitumen.

Turning to FIG. 3, the arrangement for monitoring and controlling the reactor system will now be described in detail. There are three monitor points: a first thermocouple 100 mounted in duct 84 upstream of both bleed 92 and fan 88 to respond to the temperature of the gases exhausting from the interior of the drum; a second thermocouple 102 mounted adjacent the mix outflow port 83 to measure the temperature of the product mix, and a pressure sensor 104 straddling the interior and exterior of the drum to monitor the relative total gas pressure of the drum interior. Sensor 104 is located at the boundary between combustion chamber 66 and treatment chamber 63.

Sensors 100, 102 are coupled into a first control circuit 110 which determines the setting of burner fuel and air intake modulating motor 112. Product variables measured by sensor 102 are feed both to an operator readout device 114 and to a controller 116 in which the desired values of the variables are set. Twin control outputs **116*a*, 116*b* of the controller 116 and the control output 118*a* of a corresponding controller 118 coupled to thermocouple 100 lead to a switch relay 120. Thermocouple 100 also feeds its readings to a visual indicator 124 and to a peak temperature shutdown alarm 126. On start up, because some time elapses before product appears at output 83, motor 112 operates in dependence upon approximate manual settings made at either a panel automanual control 122 or a like field control 124 or upon the outputs of controller 118, itself preset according to approximate requirements. Once a given measurable quantity of product appears at port 83, a signal on output 116*a* switches relay 120 to thereafter transmit control signals from output 116*b***, these being dependent on comparison of measured and preset values of the product temperature variables. The arrangement is such as to effect admission of more fuel and air, and thereby increase combustion, when the product temperature falls below a prescribed lower limit, while reducing fuel and air intake on recordal of a temperature predetermined as excessively high by being above the preset limit.

Pressure sensor 104 is the monitor point of second and separate control circuitry 130 coupling sensor 104 to damper motor 132. Sensor 104 includes a transducer 134 for converting the pressure response to an electrical signal which is in turn fed to a controller 136. The result of comparison of the recorded pressure value with the present value is used to adjust damper 92 by way of motor 132, an automanual control 138 being provided for initial set-up and override control purposes. If pressure in the drum falls below a given lower limit set at controller 136, bleed damper 92 is opened to increase its proportional contribution to the constant exhaust mixture and thus to throttle back outflow from the drum. Correspondingly, an excessively high drum pressure is relieved by reducing flow at the bleed.

It is believed that the desired values for the principal product characteristics such as temperature, moisture content, constituent proportions and rate of output can be reflected in terms of the two monitored variables product temperature and drum pressure. Thus, and in accordance with the preferred practice of the invention, it is considered possible to control the whole process by determining limits for these two variables on the basis of desired limits for all the product variables and then to set those limits into the respective controllers 116 and 136. In general, the aim is to control the reactor so as to ensure completion of combustion at the burner and to maintain the temperature of the gas flow below the stoichiometric value for the burner system at a level consistent with liquefaction but not burning or fractionation of the binding agent, and so that, independently of the rate of oxygen combustion by the burner, the volume rate of withdrawal is just as required to ensure efficient removal of gaseous combustion products and unburnt gases, and of water vapour to the extent required to reduce moisture in the output hot mix to the level specified, and to maintain a neutral atmosphere in the interior of the drum with respect to the binding agent. The controlled presence of a neutral atmosphere with respect to the binding agent assists in the conversion process and in minimizing burning or fractionation of the bitumen. Sufficient cooling air is introduced to maintain the temperature in the drum at desired levels for liquifying the bitumen while ensuring that loss of bitumen through oxidation or like damage is maintained within acceptable limits. The presence of excess air in the drum and of a cooling airflow of excessive volume is believed to be prevented, thus minimising burning and assisting in keeping noise levels to a minimum. Desirable also, the atmosphere in the drum is held slightly negative to minimize leakage therefrom.

By using the heated gaseous flow in the drum to heat the base products and thereby avoiding direct flame contact, it is possible to introduce the products as an homogenized and stabilized mix. As a result, the rate of production of fines is much reduced from the levels unavoidable in prior systems where a dry aggregate mix was tumbled and heated by flame contact, yet bitumen oxidation and entrainment is kept at acceptable levels.

It is of course not intended that the invention be limited to the production of heated bituminous mixes. For example, the illustrated reactor could be employed to heat and dry an aggregate mix only, the retrieved unbound mix being then combined with binding agent in a subsequent batchwise process. In this case, many of the advantages discussed above are still to be gained by employment of the inventive principles.

I claim:

1. A method of producing a heated aggregate mix comprising the steps of:

feeding base products including an aggregate mix into a closed treatment chamber via a base products feed port;

maintaining a flow of gases through the chamber;

tumbling the base products in the chamber while heating them, by means of a burner disposed at one end of the treatment chamber, to a temperature sufficient to convert the base products to a heated mix of desired specification; and retrieving the heated mix from the chamber via a heated mix retrieval port;

and further comprising the step of supplying air to the treatment chamber at a rate which is determined automatically in direct dependence upon the rate at which fuel is supplied to the burner, and wherein said flow of gases through the chamber is controlled automatically in direct dependence upon the gas pressure monitored in the treatment chamber in the vicinity of whichever of the base products feed port and the heated mix retrieval port is nearer the burner.

2. The method of claim 1 wherein the base products are heated without direct flame contact from said burner.

3. The method of claim 1 or 2 further comprising mixing and to at least a large extent stabilizing and homogenizing the base products prior to their being fed to the treatment chamber.

4. The method of claim 1 or 2 wherein said controlling of the gaseous flow includes controlling the volume rate of exhaust of gases from the chamber.

5. The method of claim 4 comprising withdrawing a mixture of exhaust gases and external air from the chamber at a constant rate, and controlling the volume rate of exhaust of gases by controlling the proportion of external air in the mixture of exhaust gases and air.

6. The method of claim 1 or 2 comprising controlling the gaseous flow in dependence on a comparison of the measured pressure in the treatment chamber with a preset value.

7. The method of claim 1 or 2 wherein said base products include a bituminous binding agent and the method comprises feeding the base products to the treatment chamber towards the burner end thereof, and heating said base products while being tumbled to a temperature sufficient to convert the base products to a heated bituminous mix in which the binding agent is adheringly coated on the aggregate particles.

8. The method of claim 1 or 2 comprising controlling both the air supplied to the treatment chamber and the fuel supplied to the burner in dependence upon the temperature of said retrieved mix.

9. The improved method of claim 1 or 2 further comprising monitoring the pressure just axially nearer the burner than whichever of the base products feed port and heated mix retrieval port is nearer the burner.

10. A reactor for producing a heated aggregate mix comprising:

a bodying defining a closed treatment chamber, which body is mounted for rotation about a predetermined longitudinal axis and arranged to permit tumbling of its contents when in such rotation;

an inlet port for feeding base products including at least an aggregate mix into the treatment chamber, an outlet port for retrieving heated mix from the treatment chamber;

respective inlet and outlet ports for admitting air to the treatment chamber at or adjacent one axial end thereof and exhausting gases at or adjacent the other axial end;

means for inducing a flow of gases through the chamber to the gas exhaust port;

a burner for heating the base products in the chamber to a temperature sufficient to convert them to a heated mix of desired specification;

means for maintaining said base products feed port and said mix retrieval port substantially airtight during use of the reactor;

means for supplying air to the treatment chamber via said air inlet port at a rate which depends directly upon the rate at which fuel is supplied to the burner;

a sensing device within the treatment chamber for monitoring gas pressure therein in the vicinity of whichever of the base products feed port and the mix retrieval port is nearer the burner; and means for controlling said flow of gases in direct dependence upon the gas pressure monitored by said sensing device.

11. The reactor of claim 10 wherein the flow control means includes valving positioned to control the volume rate of flow through the gas outlet port.

12. The reactor of claim 11 wherein a constant evacuation rate exhaust fan is mounted in an exhaust duct communicating the gas outlet port and wherein said valving comprises an adjustable bleed from atmosphere interposed in the exhaust duct between the gas outlet port and the fan.

13. The reactor of claim 10 wherein said flow control means includes comparison means to compare the pressure monitored by said sensing device with a preset value and to pass a control signal dependent upon said comparison to a device for adjusting gas flow through the gas outlet port.

14. The reactor of claim 10 wherein a second sensing device is positioned at or adjacent said heated mix retrieval port for monitoring the temperature of the retrieved mix, said burner being coupled to said second sensing device for controlling said fuel supply to the burner in dependence upon the monitored temperature.

15. The reactor of claim 10 further including means to mix and to at least a large extent stabilize and homogenize the base products prior to their being fed to the treatment chamber.

16. The reactor of claim 10 wherein the sensing device is disposed just axially nearer the burner than whichever of the base products feed port and mix retrieval port is nearer the burner.

* * * * *